US005673789A

United States Patent [19]

Degraff-Eugene

[11] Patent Number: 5,673,789

[45] Date of Patent: Oct. 7, 1997

[54] DRINKING CUP PACKAGE

[76] Inventor: Joyce V. Degraff-Eugene, P.O. Box 367, New Lisbon, N.J. 08064-0367

[21] Appl. No.: 739,011

[22] Filed: Oct. 28, 1996

[51] Int. Cl.[6] ..... B65D 83/00

[52] U.S. Cl. ..... 206/217; 206/457

[58] Field of Search ..... 206/216, 217, 206/457, 459.5, 829

[56] References Cited

U.S. PATENT DOCUMENTS

| | | | |
|---|---|---|---|
| D. 259,533 | 6/1981 | Frodsham . | |
| D. 330,481 | 10/1992 | Green . | |
| 2,766,796 | 10/1956 | Tupper . | |
| 3,461,554 | 8/1969 | Aykanian . | |
| 3,925,890 | 12/1975 | Frodsham . | |
| 4,324,338 | 4/1982 | Beall . | |
| 4,795,028 | 1/1989 | Wittig et al. . | |
| 5,085,330 | 2/1992 | Paulin . | |
| 5,165,546 | 11/1992 | Jaeger et al. . | |
| 5,180,079 | 1/1993 | Jeng | 206/217 X |
| 5,504,663 | 4/1996 | Tucker | 206/217 X |

FOREIGN PATENT DOCUMENTS 1031738 5/1978 Canada .

*Primary Examiner*—Jacob K. Ackun
*Attorney, Agent, or Firm*—Richard C. Litman

[57] ABSTRACT

A drinking cup package intended to acclimate a water-drinker to drink local distasteful water by providing a complete unit for adding flavors to the local water. The package contains a cup, a cup cover, a combined straw and spoon, a cap for the straw, and an enlarged storage base which contains flavoring agents. The cup and/or an insulating cup jacket is decorated with tropical fruits to encourage the drinking of the flavored content.

3 Claims, 1 Drawing Sheet

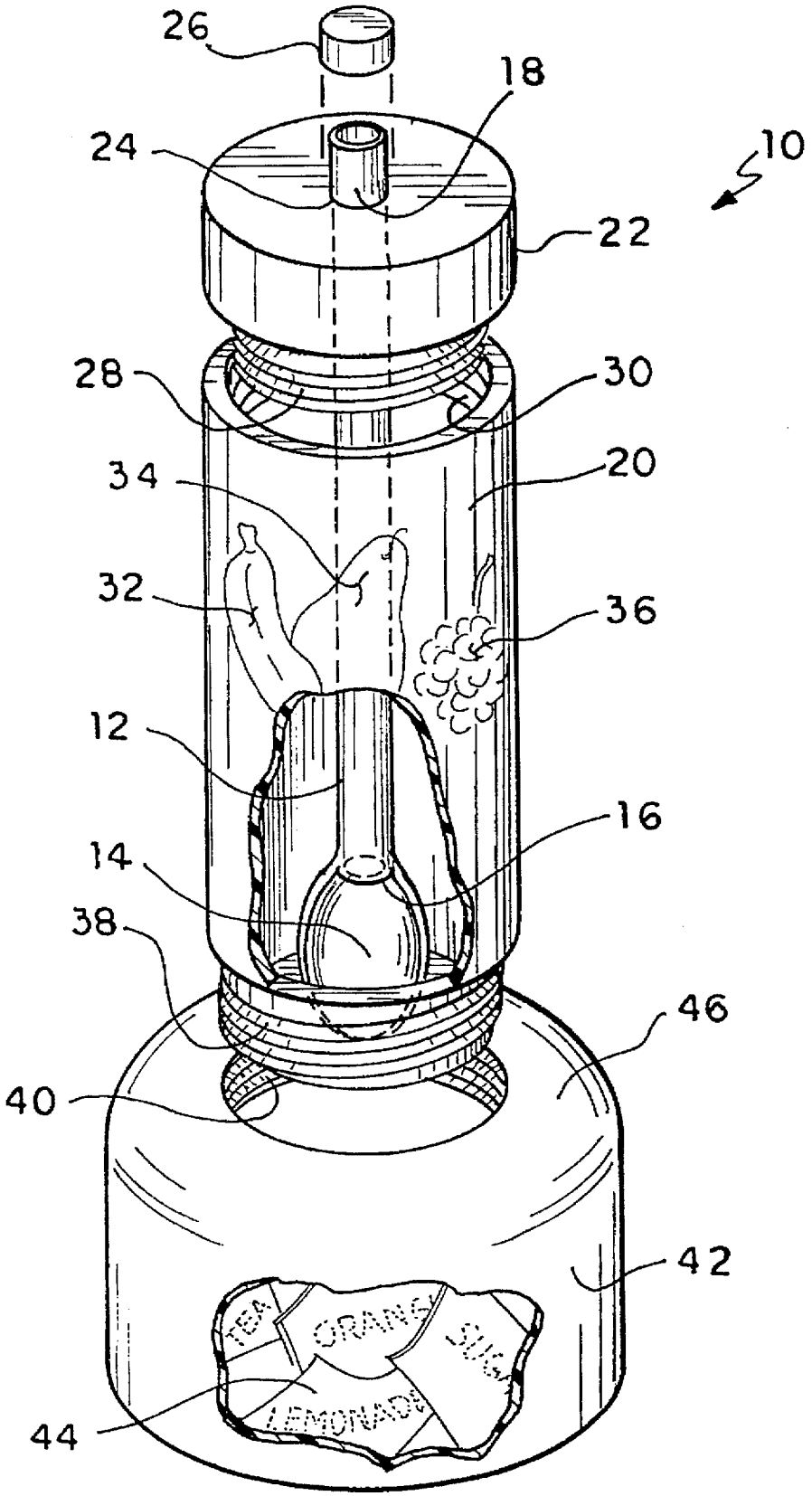
26
18
24
10
22
28
30
34
20
32
36
12
16
14
38
46
40
42
TEA
ORANGE
JUICE
LEMONADE
44

DRINKING CUP PACKAGE

CROSS REFERENCE TO RELATED APPLICATION

This application is based on Provisional patent application Ser. No. 60/016,945, filed May 6, 1996.

1. FIELD OF THE INVENTION

The present invention is directed to drinking cups and, more specifically, to a drinking cup package having separate, packaged flavoring agents included.

2. DESCRIPTION OF THE PRIOR ART

This invention is a drinking cup package intended to encourage individuals who find the local drinking water distasteful to add flavoring conveniently to avail themselves of the necessary liquid intake which would compensate for body fluid loss or quench their thirst. Continued use of this invention would eventually acclimatize the individuals to drink the unflavored local water. The drinking cup package includes a cup with a removable cover having a combination straw and spoon for stirring in the packaged flavoring agents which are conveniently stored in a removable hollow base. The packaged flavoring agents can be tea, lemonade, orangeade, artificial sweeteners, commercially available powdered and flavored drink preparations, e.g., tropical drink, and the like. The removable storage base is intentionally larger in diameter than the cup to provide stability to the drinking cup. The straw-spoon has its own removable cover and is centered by a central bore in the removable cover. As a further inducement to drink flavored water, the outside surface of the transparent cup is decorated with fruits such as pineapple, banana, pear, mango, grapes, strawberry, watermelon, apple, orange, lemon, lime, etc.

The prior art has not recognized the problem solved by the present invention. Individuals who find the local drinking water distasteful, disagreeable, unpleasant or objectionable can still avail themselves of a means to carry their drinking cup package when they leave their home to avail themselves of the pleasant tasting flavors contained in the packaged mixtures carried in the storage base of the present invention. The prior art appears to be concerned with combining complementary products and pharmaceutical or religious preparations in a second attached compartment on top or at the bottom. Furthermore, the prior art does not provide for a straw-spoon for stirring the flavoring solids and confining the straw-spoon in the cup. The pertinent prior art will be discussed in the order of their perceived relevance to the present invention.

U.S. Pat. No. 3,461,554 issued on Aug. 19, 1969, to Ardashus A. Aykanian describes a flexible combination drinking straw and spoon which can be used for drinking milk shakes, crushed ice drinks, and even ice cream. The spoon can be bent to enable the drinking of liquids from the bottom. There is no suggestion for employing an apertured cup cover.

U.S. Pat. No. 2,766,796 issued on Oct. 16, 1956, to Earl S. Tupper describes a vacuum sealed cup wherein the sealed cover can be supplied with various materials such as pharmaceutical tablets, sugar for the hot coffee in the cup, and crackers and butter for the soup in the cup. Although a stirrer for a cocktail is described, the stirrer does not perforate the cover and come with the cup package.

U.S. Pat. No. 4,324,338 issued on Apr. 13, 1982, to Robert Beall describes a compartmented cup without requiring a straw utilized for administering the sacramental elements or taking medicine. The cup can have gummed covers for the top and the bottom. A slidable bottom cover is described. There is no other use for the sacramental or medicinal cup.

U.S. Pat. No. 4,795,028 issued on Jan. 3, 1989, to Norman P. Wittig et al. describes combination beverage package having a coverless cup with a bottom chamber for dispensing a complimentary product. The chamber container can be removed by means of a handle. There is no suggestion for adding a cover or a straw-spoon.

U.S. Pat. No. 5,085,330 issued on Feb. 4, 1992, to Kenneth R. Paulin describes a drinking bottle attachment for storing a carbonated beverage and ice cream. The drinking bottle attachment is threaded onto the top of the drinking bottle containing a carbonated beverage. The upper drinking attachment has internal platforms which confine the ice cream, and a spout and air holes on the top. The user creates the ice cream float by tipping the drinking apparatus as the spout is placed within the user's mouth. There is no suggestion for utilizing a straw-spoon.

U.S. Pat. No. 5,165,546 issued on Nov. 24, 1992, to Arthur L. Jaeger et al. describes a plastic pharmaceutical container which is provided with a removable bottom section which defines a cavity adapted to hold the package circular. The bottom section is threaded onto the container, and has two diametrically opposed openings which permit the package circular to be inserted and removed. A conventional screw cap covers the mouth of the pharmaceutical container. There is no suggestion for utilizing the container as a drinking vessel.

Canadian Patent No. 1,031,738 issued May 23, 1978, to Andrew P. Shveda describes a combination package for a primary product and a secondary product complementary to the primary product. The cup can contain ice cream with the bottom compartment containing a packaged sauce which can be obtained by removing a bottom cover. A larger capacity cup can contain popcorn or beer with a napkin, packaged nuts or the like stored in the bottom compartment. There is no suggestion for adding a straw-spoon to the combination package.

U.S. Pat. No. 3,925,890 issued on Dec. 16, 1975, to Vaughn D. Frodsham describes a plastic spoon attachment for a soda straw which is attached initially to a conventional container cover.

U.S. Des. Pat. No. 259,533 issued on Jun. 16, 1981, to Vaughn D. Frodsham describes a spoon straw wherein the straw continues toward the tip of the spoon's bowl.

U.S. Des. Pat. No. 330,481 issued on Oct. 27, 1992, to Lori L. Green describes a spoon straw with a knurled handle and the tube's opening at the tip of the spoon's bowl.

None of the above inventions and patents, taken either singly or in combination, is seen to describe the instant invention as claimed.

SUMMARY OF THE INVENTION

Accordingly, it is a principal object of the invention to provide an inducement drinking cup package for encouraging and conditioning a non-water drinker to eventually drink the distasteful water from a local tap.

It is another object of the invention to provide a convenient drinking cup package which utilizes objectionable tasting water to be readily mixed with flavorful powder mixtures which are packaged and stored in the removable base of the drinking cup package.

It is a further object of the invention to enable the user to travel on trips to localities which may have distasteful drinking water with the benefit of the drinking cup package of the present invention.

Still another object of the invention is to provide a decorated drinking cup package which would encourage drinking of the locally obtained drinking water.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The FIGURE is an exploded, partially cutaway perspective view of the drinking cup package. The cup and the storage base have been partially cut out to expose the included items.

DETAILED DESCRIPTION OF THE PREFERRED EMBODIMENT

The present invention provides a drinking cup package which is intended for the individual who either finds the local drinking water distasteful at home or elsewhere. The present invention provides a psychological inducement and self-training device, wherein the drinking cup package conveniently provides the means to carry all the accoutrements required to convert the disagreeable tasting water to a pleasurable drink. Desirably, after a period of time, the individual can become acclimated to the pure unflavored drinking water. As a further psychological inducement to drink the liquid contents from this cup, the exterior of the cup is attractively decorated with tropical fruits and the like. The inventive drinking cup package contains a spoon-straw for mixing the flavoring ingredients, but still maintains the spoon-straw centered in the cap. The straw end conveniently has a removable cap which can have a holding loop or an attachment strap to the cup cover (not shown). The cup cover, cup top and bottom, and the storage base are threaded for better securement of the package parts. The storage base is large enough to provide ample room for a number of packets, e.g., six or more, which contain flavoring agents such as tea, lemonade, orangeade, artificial sweeteners, sugar, and commercially available powdered and flavored drink preparations. The large storage base also provides better stability for the cup and its contents. Although the main purpose of the drinking cup package is to be transported without a liquid content, as long as the cup when filled is upright, the liquid can be kept from spilling due to the secured cap on the straw and the screwed on cup cover.

In the figure, the drinking cup package 10 is illustrated in an exploded fashion with a partial cut out of two portions to better visualize the working parts. The straight straw-spoon 12 has a spoon bowl 14, a straw bottom aperture 16, and a straw handle 18. The straw-spoon 12 is confined in a cylindrical cup 20. The cup cover 22 has a central bore 24 through which the straw-handle 18 extends. The bore 24 is large enough to permit rotation of straw-spoon 12 for mixing, but is still adequate to minimize leakage of the liquid content. The straw-handle has a cap 26 which fits frictionally, and can have a tethering strap connected either to the straw-handle by a loop or fastened to a button on the cover 22 (not shown). The cover 22 has external threading 28 on its bottom edge to secure to the internal threading 30 at the top of the decorated cup 20. The cup can be basically transparent, translucent, frosted or lightly colored with tropical fruits decorating the outside surface. The fruits depicted are a banana 32, a pear 34 and a bunch of grapes 36. Other fruits such as pineapple, mango, etc. as listed above can be equally enticing to the drinker.

The straw-spoon rests on the bottom 38 of the cup 20 to stir the powdered flavoring ingredients and aid the dissolving process. The straw's bottom aperture 16 is purposely located adjacent to the spoon bowl 14 in order to minimize the plugging of the straw by any undissolved flavoring solids.

The cup 20 has a bottom with external threading 38 which secures the cup to the internal threading 40 of the storage base 42. The storage base 42 has a larger diameter than the cup 22 to provide an ample storage facility and stability for the cup and its contents. Packets 44 of powdered ingredients such as tea, tropical drinks, lemonade, sugar, etc. are kept within the storage base 42. An upper sloping shoulder 46 of the top portion of the storage base 42 adds to the ergonomic utility of the drinking cup package 10.

The drinking cup 20 can conveniently hold at least 8 fluid oz. of flavorful liquid. Larger or smaller size cups can be accommodated. It is contemplated that a styrofoam cover or jacket (not shown separately) for the cup 20 with the decorated tropical fruits can be added if the user prefers to maintain a cold drink. The drinking cup package can be made entirely of plastic material such as polyethylene, polypropylene and the like. The straw-spoon 12, cup 20, cup cover 22, cap 26, and the storage base 42 can be transparent or lightly colored.

It is to be understood that the present invention is not limited to the sole embodiment described above, but encompasses any and all embodiments within the scope of the following claims.

I claim:

1. A drinking cup package comprising:

a decorated cylindrical cup having internal threading at its open top and internal threading at its closed bottom;

a cup cover having a centered bore and external threading at its bottom which cooperates with the internal threading of the cup at its open top to close the cup at its top;

a straw-spoon which consists of a spoon portion which rests on the bottom of the cup and a straw portion which extends through the bore of the cup cover;

said straw portion end covered by a friction fitting cap;

said internal threading of said decorated cylindrical cup bottom cooperating with an internal threading of a storage base having a diameter larger than the diameter of said decorated cylindrical cup and having an upper sloping shoulder; and said storage base dimensioned and configured to contain packets of powdered and dissolvable flavoring, whereby a user can add distasteful water and said flavoring to the cup, stir with the straw-spoon to mix the flavoring, and drink the resulting flavorful mixed drink.

2. The drinking cup package according to claim 1, wherein an insulating styrofoam jacket with decorated tropical fruits surrounds the cup.

3. The drinking cup package according to claim 1, wherein the exterior of the cup is decorated with tropical fruits.

* * * * *